US008755493B2

(12) United States Patent
Travish et al.

(10) Patent No.: US 8,755,493 B2
(45) Date of Patent: Jun. 17, 2014

(54) APPARATUS FOR PRODUCING X-RAYS FOR USE IN IMAGING

(75) Inventors: Gil Travish, Los Angeles, CA (US); Rodney Yoder, White Plains, NY (US); James Rosenzweig, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 173 days.

(21) Appl. No.: 13/345,272

(22) Filed: Jan. 6, 2012

(65) Prior Publication Data

US 2012/0170718 A1 Jul. 5, 2012

Related U.S. Application Data

(63) Continuation of application No. PCT/US2010/044762, filed on Aug. 6, 2010.

(60) Provisional application No. 61/232,317, filed on Aug. 7, 2009.

(51) Int. Cl.
*H01J 35/00* (2006.01)
*H01J 35/06* (2006.01)

(52) U.S. Cl.
USPC ..... 378/122; 378/136; 977/949

(58) Field of Classification Search
USPC ..... 378/91, 119, 121, 122, 136, 210; 250/370.01, 370.08, 370.09, 423 R, 250/424, 423 F, 493.1, 526, 338.3; 977/742, 977/743, 745, 810–812, 832, 833, 837, 902, 977/904, 931, 932, 939, 949, 950
See application file for complete search history.

(56) References Cited

U.S. PATENT DOCUMENTS 3,840,748 A * 10/1974 Braunlich ..... 378/122
4,670,894 A * 6/1987 Birnbach et al. ..... 378/122
(Continued)

FOREIGN PATENT DOCUMENTS

JP 200275858 A 3/2002
JP 2002134050 A 5/2002
(Continued)

OTHER PUBLICATIONS

Danon, Y.—"A Novel Compact Pyroelectric X-Ray and Neutron Source"—Rensselaer Polytechinic Institute, Aug. 2007, pp. 1-196.
(Continued)

*Primary Examiner* — Anastasia Midkiff
(74) *Attorney, Agent, or Firm* — John P. O'Banion

(57) ABSTRACT

An apparatus for producing x-rays for use in imaging applications having a piezoelectric or pyroelectric crystal with an upper surface and a conducting film coating the upper surface. The crystal includes a plurality of field emitters formed as micrometer-scale exposed regions in the crystal having a one or more sharp peaks or ridges, or parallel trenches forming a wedge shaped emitter. The crystal is alternately heated and cooled over a period of time so that spontaneous charge polarization occurs in the crystal. The spontaneous charge polarization causes a perpendicular electric field to arise on the crystal's top and bottom faces, that is enhanced by the sharp peaks or ridges, thereby causing field emission of surface electrons from that location. X-rays are produced when the emitted electrons strike a target material located adjacent to the emitting face, and the X-rays may be filtered or collimated.

17 Claims, 10 Drawing Sheets

(56) References Cited

U.S. PATENT DOCUMENTS

| | | | | |
|---|---|---|---|---|
| 6,118,853 | A | 9/2000 | Hansen et al. | |
| 6,241,651 | B1 * | 6/2001 | Smith et al. | 600/1 |
| 7,149,282 | B2 | 12/2006 | Rangsten et al. | |
| 7,266,178 | B2 * | 9/2007 | Grodzins | 378/122 |
| 7,960,704 | B2 | 6/2011 | Bromberg et al. | |
| 2004/0028183 | A1 | 2/2004 | Lu et al. | |
| 2004/0114721 | A1 | 6/2004 | Qiu et al. | |
| 2005/0213710 | A1 | 9/2005 | Lawrence et al. | |
| 2007/0202673 | A1 * | 8/2007 | Kim et al. | 438/580 |
| 2008/0142717 | A1 | 6/2008 | Naranjo et al. | |
| 2008/0251735 | A1 * | 10/2008 | Putterman et al. | 250/424 |
| 2009/0041194 | A1 * | 2/2009 | Ito et al. | 378/122 |
| 2010/0065754 | A1 * | 3/2010 | Bromberg et al. | 250/424 |

FOREIGN PATENT DOCUMENTS

| | | | |
|---|---|---|---|
| JP | 200440121 | A | 2/2004 |
| WO | 2006/060030 | A2 | 6/2006 |
| WO | 2006103822 | A1 | 10/2006 |
| WO | 2006126643 | A1 | 11/2006 |
| WO | 2007083662 | A1 | 7/2007 |
| WO | 2007088497 | A1 | 8/2007 |
| WO | 2008123301 | A1 | 10/2008 |
| WO | 2009/052176 | A1 | 4/2009 |
| WO | 2009057493 | A1 | 5/2009 |

OTHER PUBLICATIONS

Korean Intellectual Property Office (KIPO), International Search Report and Written Opinion issued on Apr. 21, 2011, including claims searched, related PCT International Patent Application No. PCT/US2010/044762. pp. 1-14.

Brownridge et al.—"Electron and Positive Ion Beams and X-rays Produced by Heated and Cooled Pyroelectric Crystals such a LiNbO3 in Dilute Gases: Phenomenology and Applications"—State University of New York and Binghampton, May 1, 2004, pp. 1-48.

Evans, et al.—"Role of Delocalized Charges in the Pyroelectric Effect"—Air Force Research Laboratory, Wright-Patterson Air Force Based, OH, Jan. 2006, pp. 1-6.

European Patent Office, Extended Supplementary Search Report (ESSR) issued on Dec. 20, 2013 for corresponding European Patent Application No. 10807249.7 (pp. 1-5) with pending claims (pp. 6-8) pp. 1-8.

* cited by examiner

APPARATUS FOR PRODUCING X-RAYS FOR USE IN IMAGING

CROSS-REFERENCE TO RELATED APPLICATIONS

This application a 35 U.S.C. §111(a) continuation of PCT international application number PCT/US2010/044762 filed on Aug. 6, 2010, incorporated herein by reference in its entirety, which is a nonprovisional of U.S. provisional patent application Ser. No. 61/232,317 filed on Aug. 7, 2009, incorporated herein by reference in its entirety. Priority is claimed to each of the foregoing applications.

The above-referenced PCT international application was published as PCT International Publication No. WO 2011/017645 on Feb. 10, 2011 and republished on Jun. 9, 2011, and is incorporated herein by reference in its entirety.

STATEMENT REGARDING FEDERALLY SPONSORED RESEARCH OR DEVELOPMENT

This invention was made with Government support under Grant No. HDTRA1-09-1-0043 awarded by United States Defense Threat Reduction Agency (DTRA). The Government has certain rights in this invention.

INCORPORATION-BY-REFERENCE OF MATERIAL SUBMITTED ON A COMPACT DISC

Not Applicable

BACKGROUND OF THE INVENTION

1. Field of the Invention

This invention pertains generally to devices and methods for the production of x-rays, and more particularly to a pyroelectric or piezoelectric crystal based generator of x-rays that is light weight, compact and does not need a large external power supply. Field emitters formed as micrometer-scale exposed regions in the crystal having one or more sharp peaks or ridges emit electrons that impact a bremsstrahlung target to produce x-rays. A matrix or mosaic of crystals may also be used in place of a single crystal.

2. Description of Related Art

A wide variety of medical diagnostic imaging and treatment systems, industrial testing systems and security scanning systems are centered on the differences in the absorption of x-rays by different materials. The resolution of the two dimensional image of a three dimensional object produced by conventional imaging devices is often dependent on several parameters including time of exposure to x-rays and the intensity of the beam.

The conventional x-ray tube, in either rotating anode or Crooke's-tube-like configurations, is the workhorse of many medical imaging systems. While there have been countless refinements, the basic mechanism of x-ray imaging with the x-ray tube has remained unchanged for decades. Conventional x-ray tubes typically consist of an evacuated housing containing an anode and a cathode. Cathodes are electron emitting filaments often made of tungsten, aluminum, titanium or steel. Cold cathodes sometimes include a rare earth coating to enhance electron emission. Anodes are often made of metals such as molybdenum, palladium, tungsten, copper and silver.

A high-voltage supply is utilized to create an arc or discharge of electrons between the negative electron emitting cathode and the positive anode. Within the arc are electrons with kinetic energies at or near the applied potential that are accelerated through the electric field between the cathode and anode. When these accelerated electrons strike a target (typically the anode), x-rays are produced through Bremsstrahlung ("braking radiation") as well as other ionization processes (e.g. inner shell electron "characteristic radiation").

Conventional tubes can be relatively light (a few kilograms) and fragile, since they are fabricated from glass. However, the power supplies are typically large, expensive and heavy (in the tens of kilograms). The majority of the applied power goes into waste heat, requiring cooling and further adding to the bulk and weight of conventional x-ray devices.

A number of technologies have been considered to reduce the size and weight of x-ray sources. X-ray microtubes are an attempt to construct millimeter-scale devices by miniaturizing the conventional tube design. These devices still require external high voltage supplies (as well as water cooling, in some cases); however, the weight of the unit itself (excluding the power supply and cooling system) is very low. As they are typically designed for cancer therapy, where dose precision is critical, the designs are not optimized for cost. A typical number of treatment cycles per tube is ~10.

Field emitters of electrons have been investigated in a number of contexts by a variety of researchers. In principle, it is known that such field emitters or arrays of these emitters are able to produce x-rays by irradiating a bremsstrahlung target with electrons. The energy of the electrons, and hence of the x-rays emitted, is directly proportional to the applied voltage. Maintaining a sufficiently high voltage (30-120 kV) across a tiny gap without breakdown is very challenging and has been a barrier to miniaturization. (Field emitter arrays used in e.g. plasma televisions operate at only a few hundred volts.) A variant technology, the cold-cathode emitter array, has also been developed, and flat-panel x-ray sources based on this technology are being brought to market. This approach seems very promising, but still requires a significant external power supply.

Radioactive sources can also provide a good source of x-rays. Co-60-based-sources are still in use in developing countries for medical and dental x-rays. However, concerns about safety and nuclear material proliferation make these systems very undesirable. Moreover, shielding of the sources implies that devices tend to be very heavy on the order of hundreds of kilograms.

There is one known x-ray source based on the pyroelectric effect. It relies on a bulk pyroelectric crystal emitting electrons that then impact a copper target. The resultant x-rays are emitted through a beryllium window of 15 mm diameter. This source is able to produce sporadic fluxes of x-rays over a small emission area, and does not require a high-voltage power supply. However, it lacks repeatability or control and also has a nearly random output flux.

Accordingly, there is a need for a flat panel source of x-rays which is robust and portable and does not need a large power supply. X-ray sources can follow a similar development path televisions and video displays that have moved from tube-based technologies to flat screens. The present invention satisfies this need, as well as others, by providing an addressable modular array of x-ray sources that is self contained and useable in remote locations.

BRIEF SUMMARY OF THE INVENTION

By way of example, and not of limitation, an apparatus for producing x-rays for use in imaging applications according to the present invention preferably includes an array of pyroelectric crystals, each crystal having an upper generally planar surface with a conducting film coating. The crystal includes a plurality of field emitters and a heater/cooler adjacent the crystal. The field emitters of electrons are formed as micrometer-scale exposed regions in the crystal surface having a one or more sharp peaks or ridges.

Bulk pyroelectric crystals, such as lithium niobate, are known to generate spontaneous sporadic emissions of kilovolt electrons when heated or cooled at optimal rates. Pyroelectric crystals are normally polarized spontaneously and this polarization is compensated by surface charge at equilibrium conditions. These materials experience a change in polarization when the crystal is heated or cooled in a low pressure environment. The resulting non-compensated charge on the surface of the crystal creates an electric field that is of sufficient strength to accelerate electrons or ions.

In the preferred embodiment, the pyroelectric crystal is alternately heated and cooled over a period of several minutes so that spontaneous charge polarization occurs in the crystal. In another embodiment, the piezoelectric effect is used through mechanical rather than thermal stimulation of the crystal. In all cases, the spontaneous charge polarization causes a perpendicular electric field to arise on the crystal's top and bottom faces and the electric field arising from the exposed surface of the crystal is enhanced by the sharp peaks or ridges, thereby causing field emission of surface electrons from that location. Electron beams that are emitted from the peaks of the field emitters are directed to a bremsstrahlung target resulting in the formation of x-rays. Other uses of the electron beams produced by the emitters are also contemplated.

One advantage realized with a piezoelectric based embodiment is that it can be excited by acoustic means including transducers and mechanical actuators. In addition, it may be possible to induce the piezoelectric spontaneous polarization using a shock wave produced through a laser pulse, for example. In addition to a possibly more practical production method, the piezoelectric approach might allow for faster time scale control.

Individual piezoelectric or pyroelectric crystals are preferably mounted together in a planar array with the activation of the pressure or heating/cooling elements of each of the crystals being controlled by a controller. Control over individual crystals permits selective heating and cooling cycles of adjacent crystals over desired time scales and control over the total production of x-rays by the array. The controller permits activation of individual crystals in the array in patterns such as a checkerboard with alternating heating and cooling of adjacent crystals in the array, for example.

In the preferred embodiment, lithium niobate ($LiNbO_3$), lithium tantalate ($LiTaO_3$), barium titanate ($BaTiO_3$), triglycine sulfate (TGS) or some other pyroelectric crystal is used as an electron source. Pyroelectric crystals are preferably cut so that the top and bottom planes of the crystal are normal to the axis of polarization. At equilibrium, the spontaneous polarization of one face of the crystal is negative ($Z^-$) and the other face is positive ($Z^+$). Heating the crystal in a vacuum or low pressure atmosphere will result in an electric field and the elimination of electrons from the surface of the crystal.

It has been observed by others that upon heating the electrons from the surface of the crystal and ionized residual gases can be accelerated by the electric field of the crystal into an appropriate target to produce x-rays. It was also observed that x-rays characteristic of the crystal were produced from the ($Z^-$) surface of the crystal upon heating and x-rays characteristic of the target were observed upon cooling of the crystal. The ($Z^-$) surface of the crystal becomes positively charged upon heating and negatively charged on cooling. In addition, the strength of the electric field produced by the crystal is proportional to the surface charge density, which is a function of the temperature change and the chamber pressure.

It has also been shown that the pyroelectric electron emission in vacuum or very low pressure environments may be influenced by the gap distances between crystal surface emitter and the electron collector. For example, with large gaps (greater than approximately 2 millimeters), the electron emissions from the crystal surface is due to field ionization producing continuous plasma. However, with small gaps (less than approximately 2 millimeters), electron emissions may be influenced by intense ionization ignitions with the formation of dense plasma that can occur in addition to the field emission effect.

While the residual gas ionization effects delineated above are always present, the device disclosed here does not use this effect as a primary means of generating electron emission. Rather, here direct field emission is preferably utilized.

The characteristics of the field outside of the crystal bulk influence both electron emission as well as the energy of the emitted electrons. The electron energy will increase as the thickness of the crystal increases to a limit and can be optimized. However, pyroelectric crystals are often poor conductors of heat. Crystal thickness selection should also take into account heat conduction through the crystal over time.

Any number of field emitters may be etched or milled into the planar surfaces of the crystal using conventional techniques. Despite only requiring intermediate levels of field enhancement, it is desirous to fabricate the tips with consistent parameters. Therefore, lithographic patterning and etching techniques are preferred to ion milling and related technologies. However, any technique that will consistently produce field emitter structures in the surface of the crystal is suitable.

The individual field emitter generally comprises a micrometer-scale exposed region in the crystal having a one or more sharp peaks or ridges. The sharp peaks or ridges forming the electron emitter preferably have a height to width aspect ratio greater than one. As the surface field near a tip is sharply enhanced with decreasing tip radius, it is advantageous to fabricate tips that are as sharply pointed as possible. In one embodiment, a cylindrical or square portion of the crystal is removed leaving a central emitter with an emitting tip. In another embodiment, the central emitter is singly-pointed cylindrically-symmetric tip with a metal coating or an attached metal needle.

In another embodiment, the sharp peaks or ridges are generally pyramidal or wedge shaped and have side walls with angles of 45 degrees or greater.

In another preferred embodiment, an individual field emitter is formed by milling two parallel trenches a few micrometers apart to create a long, sharp ridge between the two trenches. This ridge can be much more sharply pointed than the cylindrical tip and leads to greater and more reliable enhanced emission. Three and four trenches can also be used to create two or more parallel electron emitting ridges within the crystal.

In another embodiment, the tip or sharp ridge of the emitter is coated with a layer of nanotubes, a rare earth metal or a heavy metal such as gold, platinum, gallium or tungsten etc. Tip coating materials that are selected are conductive and resist erosion of the tips or ridges resulting from electron emissions over time.

The field emitters that are formed in the crystal surface are preferably arranged in patterns that are equally spaced in a square grid, concentric circles or radiating lines from the center etc. The number of emitters can vary and the number selected to correspond to the desired x-ray output of the array.

The upper surface of the crystal is preferably coated with a metal coating prior to milling or etching the emitter structures within the surface of the crystal. However, in one embodiment, the emitter structures are formed in the surface of the crystal first and a layer of metal is applied after emitter formation so that there is a single uniform layer of metal over all of the surfaces. In another embodiment, the upper surface is coated with a metal coating prior to forming the emitter structures, and a second layer of conductive metal is applied to the crystal surface after the emitter structures are formed, thus covering the entire crystal face with a uniform upper layer of metal. In one embodiment, the emitter structures are part of the upper metal layer. Surface electrons produced at other locations on the crystal face can conduct through the metal film to the emitter structures, thereby providing a quasi-continuous supply of charge for field emission.

Electrons emitted from the field emitter tips or ridges are accelerated through an evacuated gap chamber to a target. The gap is preferably of dimensions that limit the spontaneous discharges from the emitter tips and favors an even beam of electrons during heating or cooling of the crystal. The pressure and composition of residual gases within the gap may also be optimized to maximize the accelerating potential and to minimize the occurrences of spontaneous discharges.

Gap pressure is preferably maintained at the UHV range of better than $10^{-6}$ Torr. In another embodiment, the gap pressure is held within the range of approximately 0.5 mTorr to approximately 100 mTorr. In one embodiment, the air of the gap chamber surrounding the crystal and between the emitters and the target is removed and replaced with one or more ballast gases such that the residual gases within the chamber are essentially uniform in composition. The dilute ballast gases can be selected based on a number of factors such as first ionization potential, electron affinity or reactivity with the component materials. Optimal pressures tend to decrease with the increase in crystal thickness and surface area.

The preferred embodiment of the invention is a modular, planar array that is self contained and easily transportable. One illustrative embodiment of the device includes a housing, a supply of batteries, controller, remote actuator, sensors and an x-ray generating panel. The preferred panel configuration is a modular array of modules that may be placed on a rigid support or a flexible support substrate. The modules preferably have an appropriately sized generally planar pyroelectric crystal placed on a temperature control layer such as a resistive heater or a Peltier junction that is controlled by a controller and may have optional temperature sensors coupled to the controller to monitor the temperature of the crystal and the x-ray output.

The surface of the crystal opposite the temperature control layer is coated with a metallic layer with regions removed over the each of the field emitters. The metallic layer equalizes the surface charge over the crystal and provides a source of free (unbound) electrons.

A target layer is disposed over the metallic layer and evacuated creating an enclosed chamber over each of the milled field emitters in the panel. The chambers are preferably sealed so that the vacuum is maintained in the chambers with multiple heating and cooling cycles of the crystal.

An optional filter and collimator may be applied to the top of the target layer to filter and collect the x-rays that are produced from the target.

In another embodiment, a second crystal is used as an anode that has the effect of nearly doubling the field in the gap and the creation of higher energy x-ray production. In the double crystal configuration, the negative surface of one crystal provides a cathode and the positive side of the second crystal as an anode resulting in the energy of the fields, electrons and x-rays to almost double.

The present invention is not limited to the foregoing examples, but can be enhanced by varying the dimensions and characteristics of the various components. For example, the response of a crystal is preferably optimized by controlling the size, purity, conductivity, dielectric coefficient, chemical composition, mounting, and roughness of the crystal. The geometry of the panel components is preferably chosen to maximize the electric field, energy of electron emission, minimization of discharges or any other desirable parameter.

Additionally, all forms of piezoelectric crystals are also appropriate, creating embodiments that include crystals where stress and strain, rather than temperature, can be used to create fields and electron beams for x-ray production. Laminated crystals can also be used. For example, the crystal comprises a layered structure having a first (lower) section as a field generator and a second (upper) section as an emitter.

Ultimately, the choice of design parameters for the entire system takes into account many different variables. The parameters include, but are not limited to, the strength and spatial dependence of the electric field, the localization of the electric field, the current of electrons emitted, and the energy and quantity of x-rays generated by the crystal with various mountings, tips, and stimuli.

An aspect of the invention is to provide an x-ray or electron source that is portable, easy to use and that does not require a large outside power source to function.

Another aspect of the invention is to provide an electron or x-ray source that is centered on a pyroelectric or piezoelectric crystal that has a plurality of electron emitters formed in the crystal with sharp points or ridges that produces parallel electron or x-ray beams.

A still further aspect of the invention is to provide an apparatus with a pyroelectric or piezoelectric crystal that has one or more layers of a conductive metal that equalizes the surface charge over the crystal and provides a source of free electrons.

Another aspect of the invention is to provide a mechanism for the control of pyroelectric emission from a crystal.

Yet another aspect of the invention is to provide an addressable modular array of x-ray sourced on a rigid or flexible support that can be produced using foundry processes.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 10 and the associated methods used to create and optimize the apparatus. It will be appreciated that the devices and systems may vary as to configuration and as to the details of the parts, and that the method may vary as to the specific steps and sequence, without departing from the basic concepts as disclosed herein.

The present invention relates to a self contained, readily transportable apparatus for the production of electrons or x-rays for use in a variety of medical or industrial applications. X-rays or electrons are preferably produced by one or more compact "flat panel" modules. Each field emitter module produces a continuous electron flux when its temperature is cycled. The emitted electrons irradiate a micro-sized spot on an adjacent bremsstrahlung target, thereby producing an x-ray flux. One or more modules can be assembled in an array and individually activated with a controller. The resulting array of x-ray sources can be configured in a number of possible arrangements, including a single point source, a line that could be swept across the region to be imaged, or a 2D array.

Although the typical module includes a plurality of field emitters arranged in a pattern on the surface of a crystal, an apparatus with a single emitter is used to illustrate the invention for simplicity.

Figure 1:
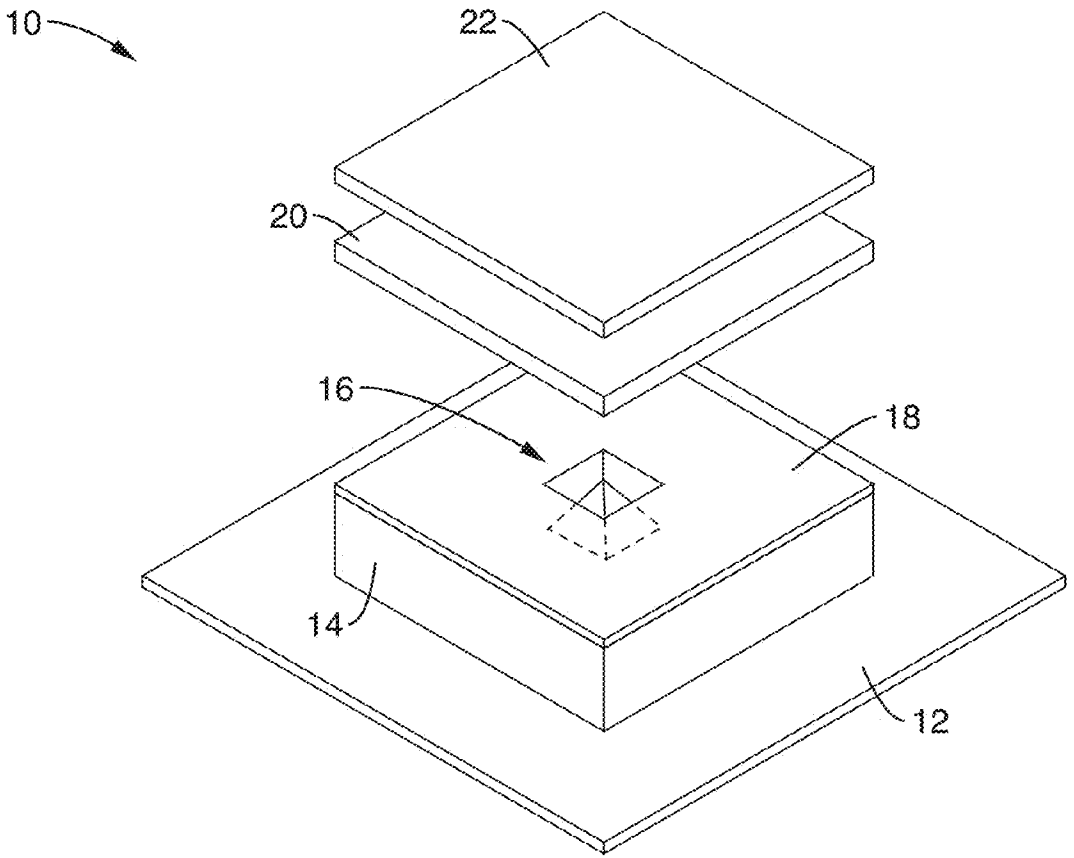
FIG. 1 is a perspective exploded view of one embodiment of a module with a single field emitter formed in the center of a pyroelectric crystal according to the invention.
Figure 2:
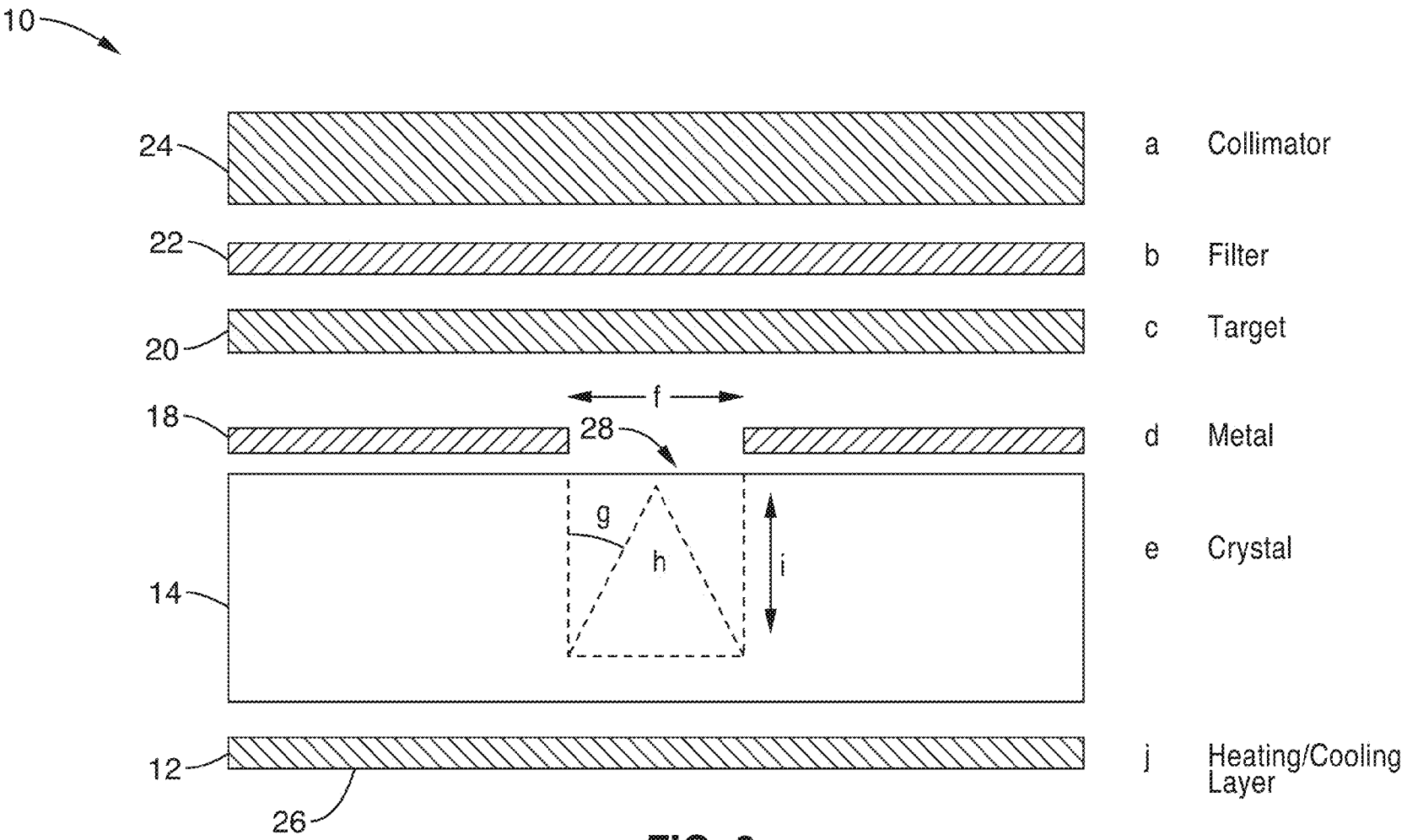
FIG. 2 is a schematic side cross-sectional view of a module with a single field emitter as shown in FIG. 1 with a top collimator layer.

Turning now to FIG. 1 and FIG. 2, a module 10 with a pyroelectric crystal and a single field enhancing electron emitter is schematically shown. In this embodiment, a pyroelectric crystal 14 is placed upon a temperature control device 12 that is preferably capable of heating or cooling the crystal over time at selected rates. For example, the temperature may be controlled by a Peltier junction, resistive film heater, cooler or similar temperature control apparatus placed on the rear (substrate-mounted) face of the crystal 14, with temperature control contacts forming the only external control necessary for the device. In one embodiment, the temperature control device 12 includes a temperature sensor that monitors the temperature of the crystal or the temperature control device and those temperatures are controlled by a controller.

As seen in FIG. 2, the bottom surface 26 of the temperature control device 12 may be mounted on a planar support substrate. One or more modules can be mounted on the support to provide a panel of independently controllable modules of any desired size. In a further embodiment, an array of emitter modules 10 could also be embedded on a flexible membrane (such as a polymer) instead of being placed on a rigid support. Such a flexible array could be folded or rolled up for transport or storage, and then unfolded and placed upon the patient for use.

The crystal 14 that is used in this embodiment can be any pyroelectric crystal that will produce an electric field with a change in temperature. Typical examples of pyroelectric crystals 14 that may be used with the emitter module 10 are lithium niobate ($LiNbO_3$), lithium tantalate ($LiTaO_3$), barium titanate ($BaTiO_3$) or triglycine sulfate (TGS). All of these emit electrons from the positive Z face during heating.

For example, a typical crystal may be cut and mounted on a substrate such that the correct face is exposed. But it is also possible to use a bulk crystal cut along the Z plane, without a substrate. In another possible construction method, a composite comprising two layers, each layer a different pyroelectric material, may be used. In this case, the lower material would provide the accelerating electric field, while the upper serves as a charge reservoir and contains field emitters.

Pyroelectric crystals such as lithium niobate are very good electrical insulators and, by the same token, poor conductors of heat. In the configuration described in FIG. 1 through FIG. 5, a heater or temperature controller on the rear (substrate) face 26 of the crystal 14 is used to raise or lower the temperature on the upper (emitting) face of the crystal 14. For optimal performance, the crystal thickness should be kept small, to allow heat conduction in reasonable time. The smallest value compatible with reasonable field gradient (which increases with crystal thickness up to some limit) is on the order of approximately one millimeter.

Although a pyroelectric crystal 14 is illustrated, it will be understood that a piezoelectric crystal and means for activating the crystal may be adapted to be used instead of a pyroelectric crystal to generate the necessary fields and electrons. Laminated pyroelectric crystals may also be used.

One possible advantage to the use of a piezoelectric based device is that it can be excited by acoustic means including transducers as well as mechanical actuators. In addition, it may be possible to induce the piezoelectric spontaneous polarization using a shock wave produced through a laser pulse. In addition to a possibly more practical production method, the piezoelectric approach might allow for faster time scale control. However, a potential disadvantage over pyroelectricity is the repeated stress induced upon the crystal, which may eventually lead to cracks or fracturing of the crystal material.

Figure 4:
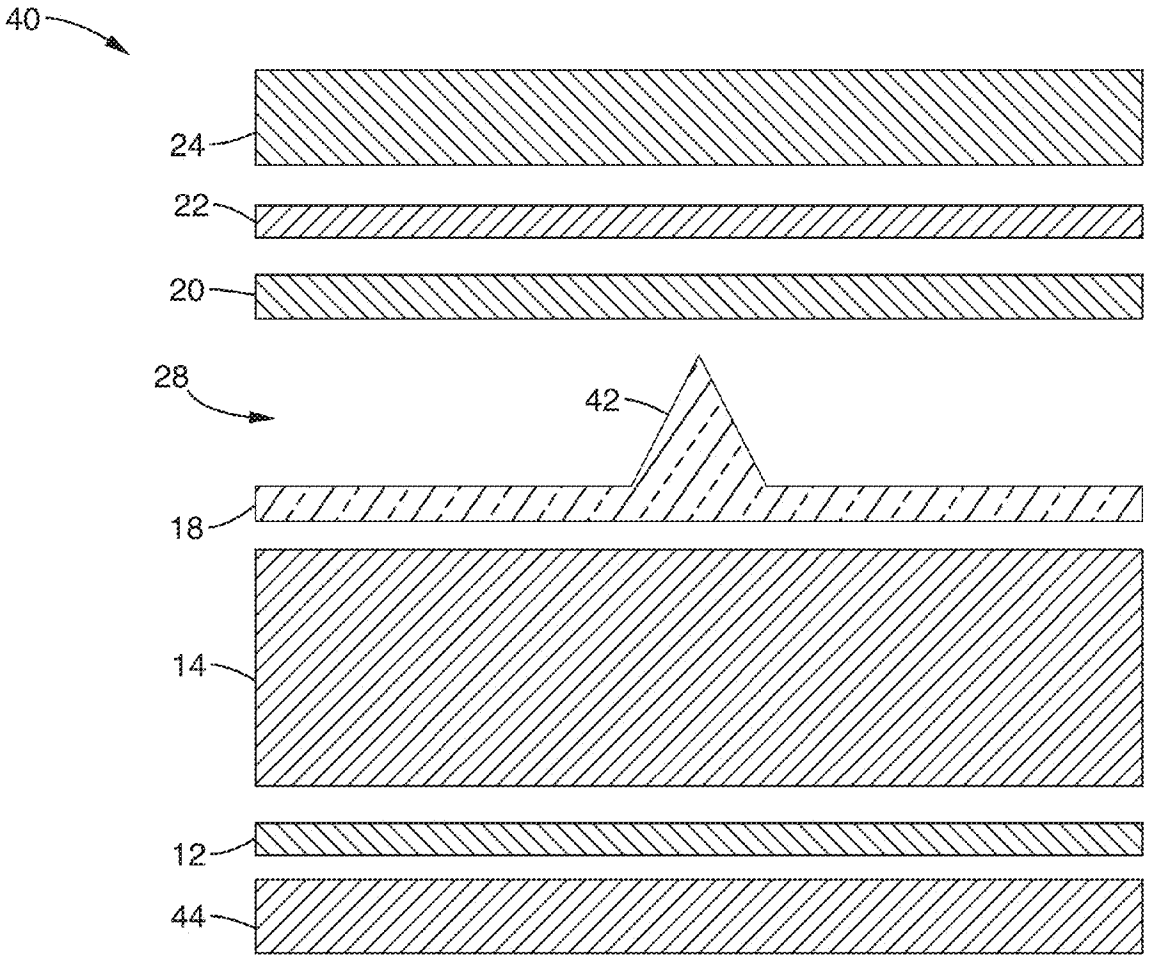
FIG. 4 is a schematic side cross-sectional view of a second alternative embodiment of a module with a single field emitter as shown in FIG. 1 with the wedge emitter formed on the metal layer on the surface of the crystal.

The emitting face of the crystal 14 surface is covered with a conducting film 18, typically a thin metallic layer of gold or platinum. The thickness of this film is sufficient to provide a robust conducting layer and is preferably between 50 nm and 300 nm. The film can be deposited via evaporation or sputtering, followed by polishing; a "wetting" layer (for example, 5 nm of chromium or titanium) can be used to give good adhesion between the crystal 14 and the metal film or layer 18. In another embodiment, the emitters are in the metallic layer as seen in FIG. 4.

As the uncompensated pyroelectric surface charge in the region near the emitting tip of emitter 16 is depleted through electron emission, additional charge produced at more distant regions of the emitting surface will be conducted through the metallic layer 18 and contribute to the emission. The metallic layer 18 therefore acts as a means to conduct the surface charge.

In every case, the operating mechanism remains the same. When the temperature of the crystal is slowly cycled (alternately heated and cooled on a time scale of several minutes or strain applied over time), spontaneous charge polarization occurs in the crystal 14, causing a perpendicular electric field to arise on its top and bottom faces. At the exposed crystal surface, the field may be enhanced by the sharp peaks or ridges of field emitters 16 produced by micromachining, leading to field emission of electrons from that location. Surface electrons produced at other locations on the crystal face can conduct through the metal film to the emitter region, thereby providing a quasi-continuous supply of charge for field emission.

Field electron emitters 16 are preferably formed in the surface of the crystal 14 after the application of conductive metal layer 18 to the surface of crystal 14. There are a number of possible methods for adding sharply pointed features to the structure that will serve as a field emitter. In one embodiment, a micrometer-scale portion of the metal surface 18 is removed from of the crystal face 14 using micromachining techniques such as focused-ion-beam milling. Despite only requiring intermediate levels of field enhancement, it is desirous to fabricate the tips with consistent parameters. Therefore, lithographic patterning and etching techniques are preferred to ion milling and related technologies when producing a tapered cylindrical tip in some embodiments. In another embodiment, as shown in FIG. 4, the emitter tips are formed within the metallic layer 18 atop the crystal 14.

As the surface field near a tip is sharply enhanced with decreasing tip radius, it is advantageous to fabricate tips that are sharply pointed. It is preferred that the fabrication of a singly-pointed cylindrically-symmetric tip by milling an annular trench into the crystal material will produces tip radii on the order of approximately 1 μm or less.

Alternatively, milling two or more parallel trenches a few μm apart can create a long, sharp ridge between the two trenches that is much more sharply pointed than the cylindrical tip and leads to greater and more reliable enhanced emission. The length of the generally parallel trenches is between approximately 5 μm to approximately 35 μm in length. Although this range is preferred, other lengths can be used.

Figure 6:
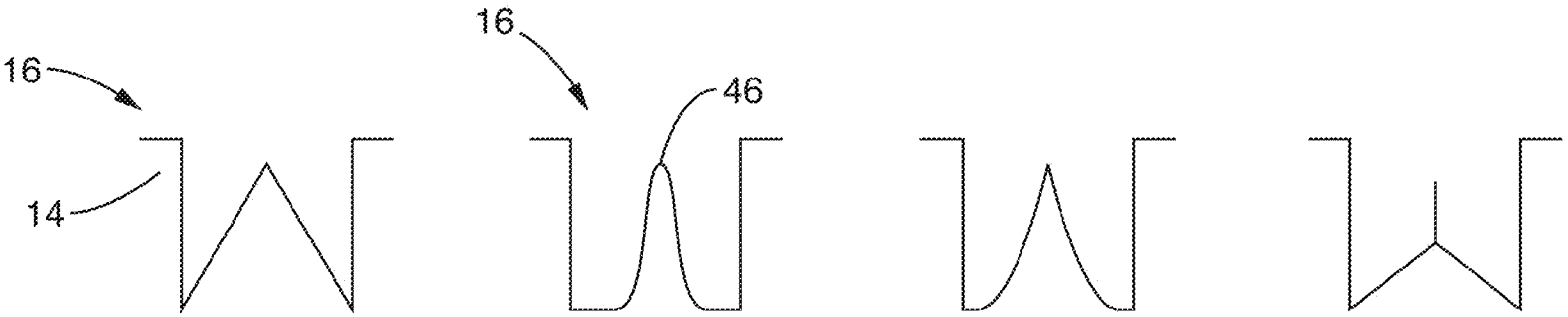
FIG. 6 are schematic cross-sectional views of alternative configurations of field emitter tips according to the invention.
Figure 7:
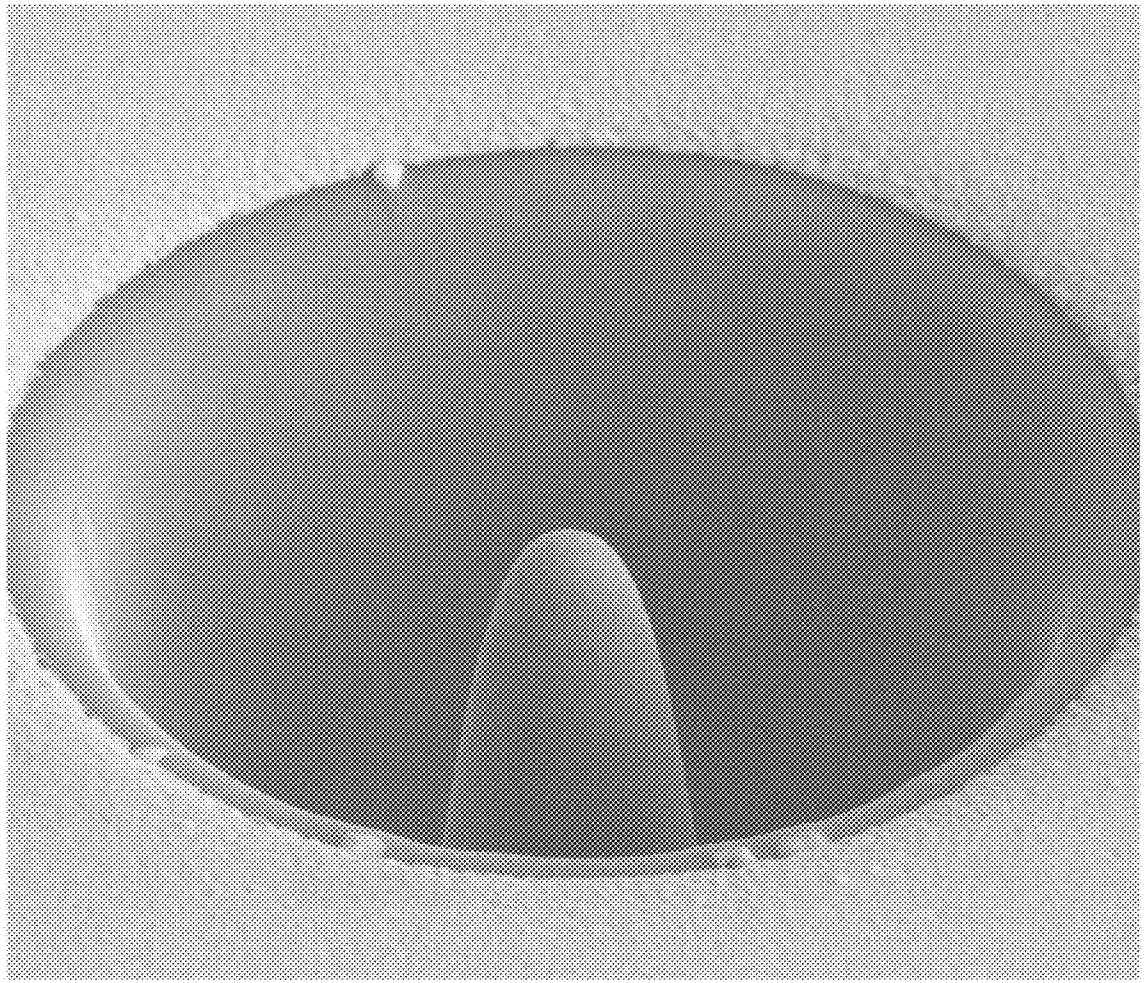
FIG. 7 is a scanning electron microscope image of one embodiment of an emitter with a circular chamber and tapered tip with a gold coating on the crystal.
Figure 8:
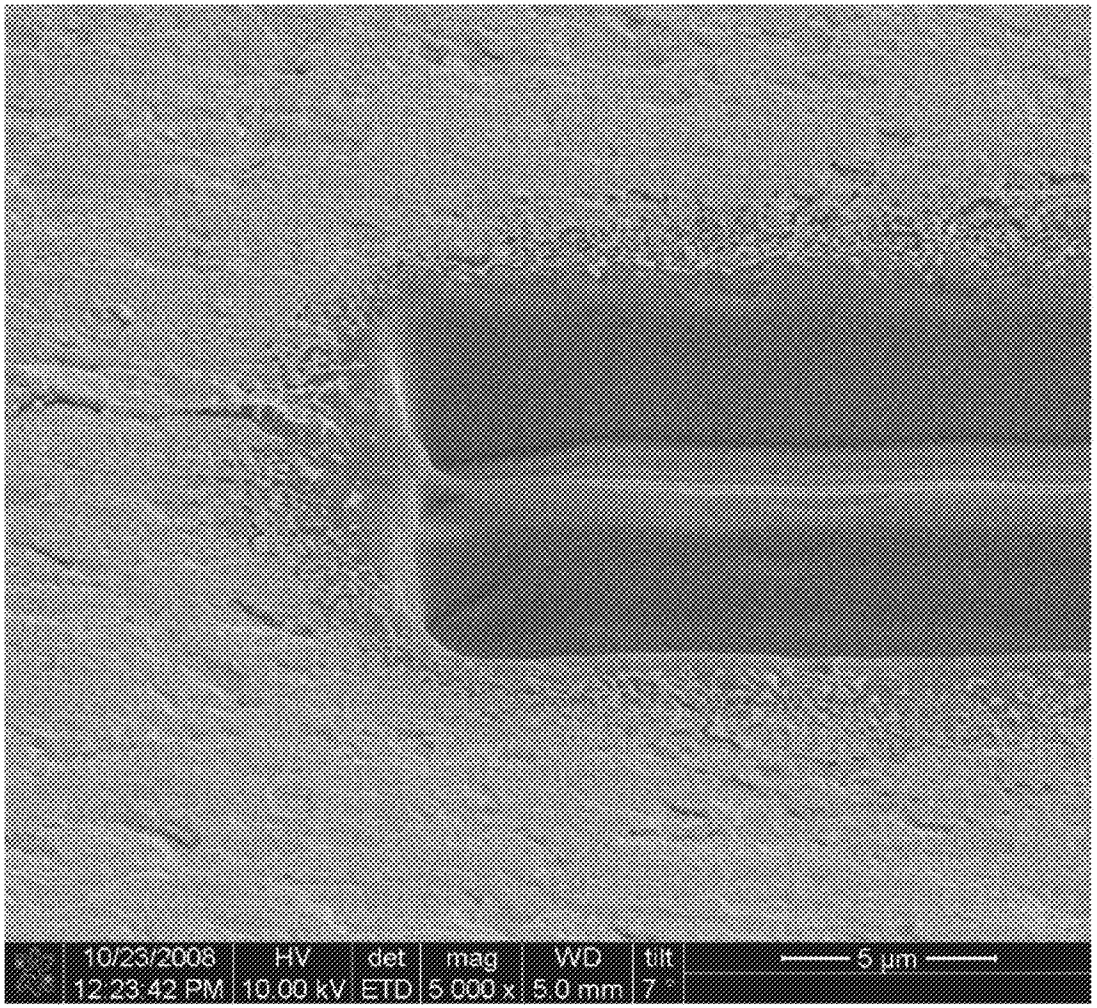
FIG. 8 is a scanning electron microscope image of a second embodiment of an emitter with parallel channels forming a wedge shaped emitter and a coating of gold on the surface of the crystal.

By way of further example, some typical cross-sectional surface profiles of illustrative embodiments of wedge or pyramid emitter tips are shown in FIG. 6. The profiles generally have a height to width aspect ratio greater than 1; are generally pyramidal or wedge shaped; and have side walls with angles of 45 degrees or greater. Scanning electron microscope (SEM) images of two individual emitter configurations are shown in FIG. 7 and FIG. 8.

Other methods exist for removing the metal and creating an emitter can be used in addition to ion milling. In one method, a pattern is laid out on the metal using a photoresistive material, which is then light-treated (lithography) and etched to create a sharp-edged emitting region. One may also attach emitting points or tips (for example, a region containing many carbon nanotubes) to a micrometer-sized region of the metal-covered surface. There are also additional fabrication technologies that can applied by one practiced in the arts to fabricate the emitter patterns.

Figure 3:
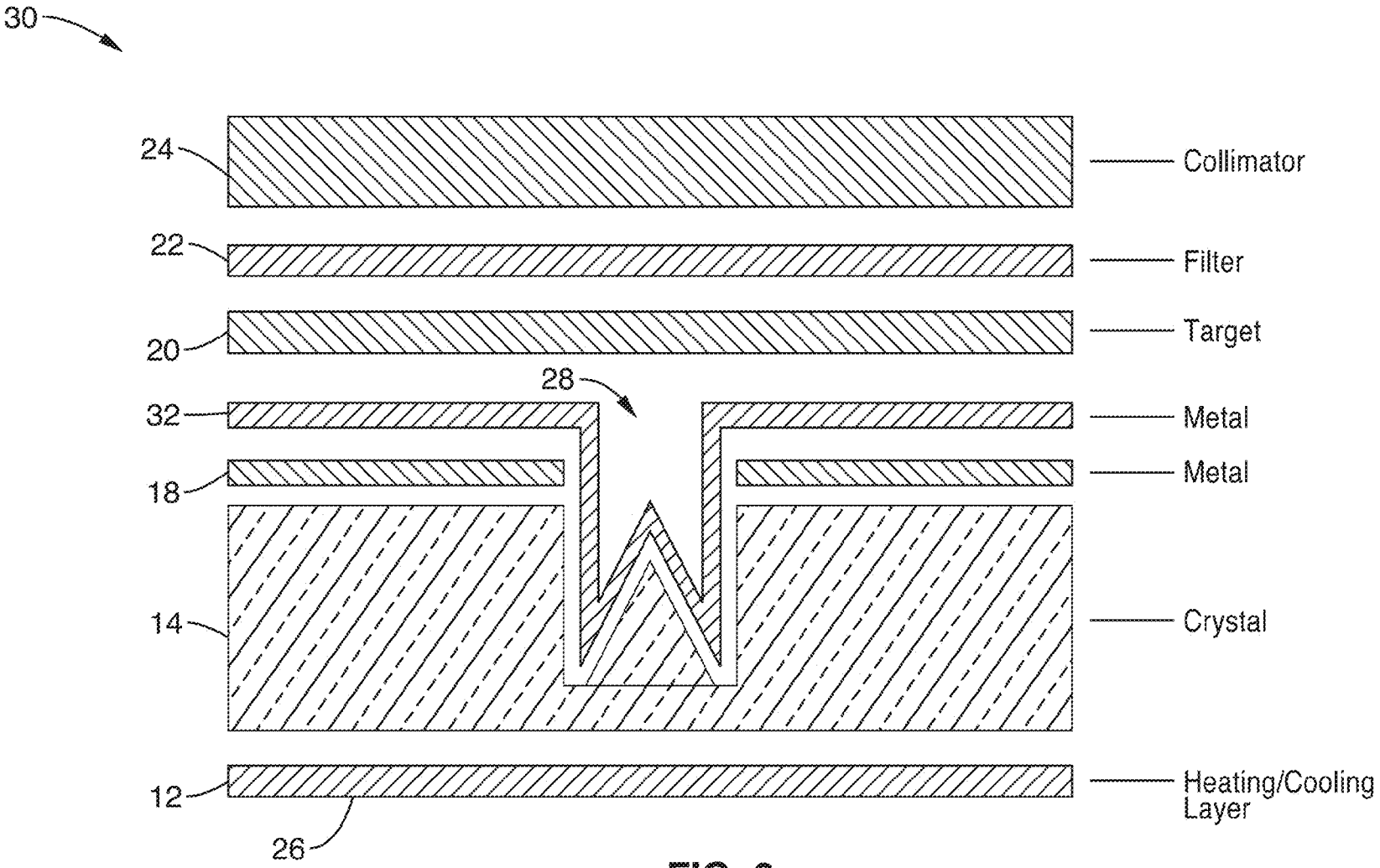
FIG. 3 is a schematic side cross-sectional view of an alternative embodiment of a module with a single field emitter as shown in FIG. 1.

An alternative embodiment 30 of the emitter portion of the panel is shown in FIG. 3. After the emitter structure is formed by exposing and excavating the crystal 14 through the metal layer 18, a second metal layer 32 is applied. The second metal layer 32 is preferably evenly applied over the first metal layer 18 and the exposed excavated emitter structure. In another embodiment, the metal layer 18 is excluded and only a single layer of metal is applied over the bare crystal and excavated emitter structures.

The second metal layer 32 can be composed of same metal as the first metal layer 18 or it can be composed of a different material. The thickness of the second layer 32 preferably ranges from approximately 50 nm to approximately 300 nm.

In the embodiment 40 shown in FIG. 4, the crystal 14 is coated with the conductive metal layer 18, but the emitter is not directly part of the crystal; rather, the emitter is formed on the surface of the metal layer 18. The emitter structures 42 preferably have sharp peaks or ridges that are generally pyramidal or wedge shaped have a height to width aspect ratio greater than one and have side walls with angles of 45 degrees or greater. In this embodiment, the gap 28 is determined by the distance from the tip of emitter 42 to the target 28 and spacers may be used to maintain the position and seal the gap 28.

Figure 9:
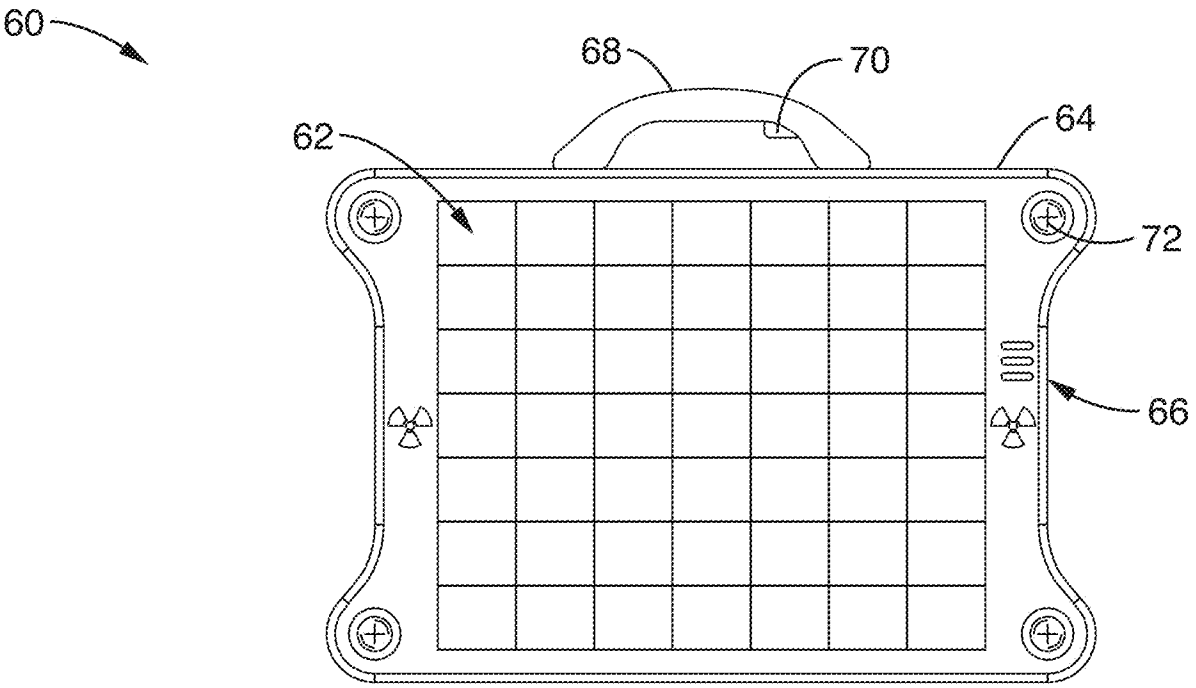
FIG. 9 is a front view of one embodiment of an array of modules according to the invention.
Figure 10:
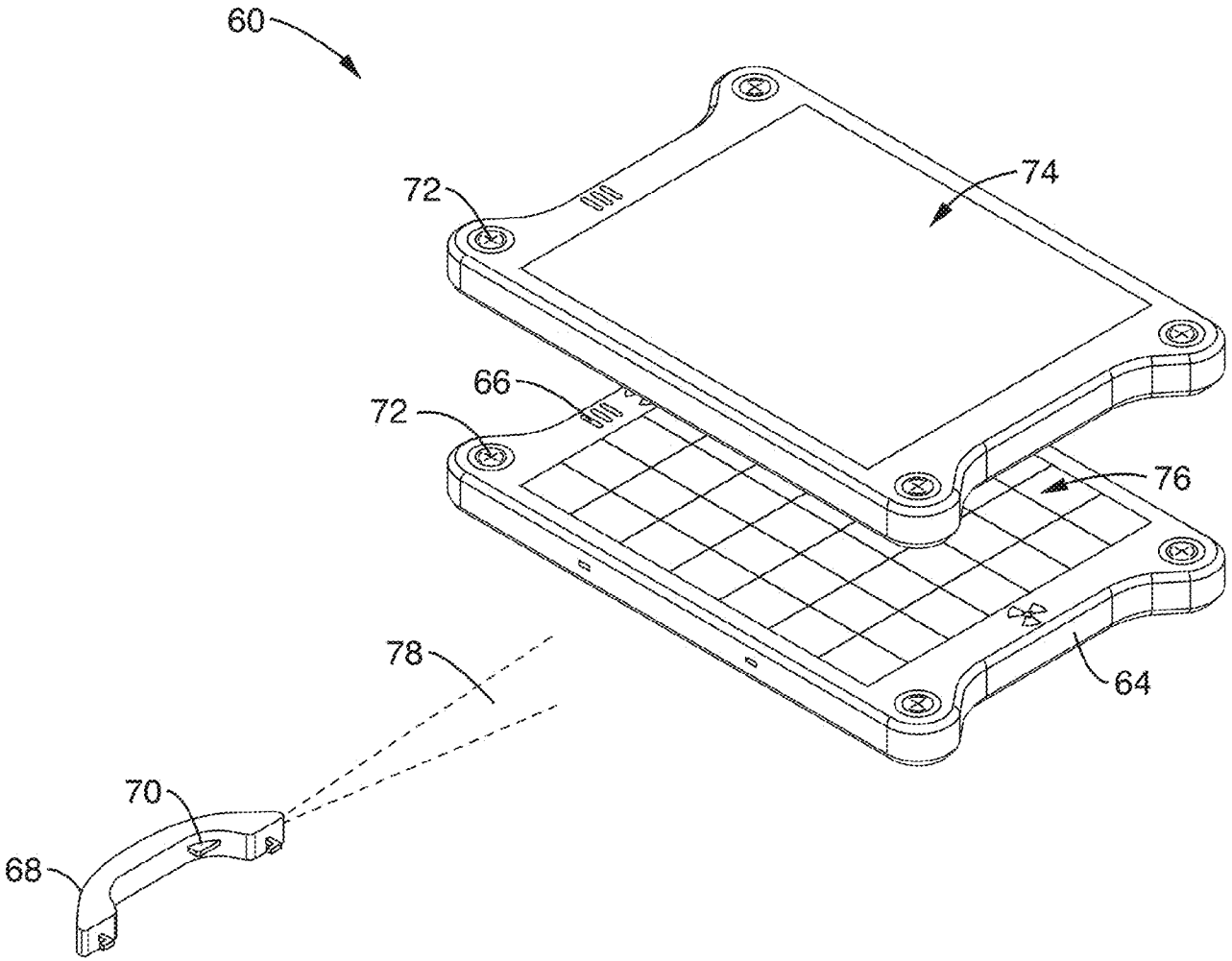
FIG. 10 is a perspective view of the array embodiment of FIG. 9 with an imager and remote actuator according to the invention.

The panels that are shown in FIG. 2 though FIG. 4 may be placed on a rigid or flexible support 44 to form an array. The array may be placed in a housing, as shown in FIG. 9 and FIG. 10, for example.

Although a single emitter is shown for simplicity if FIG. 1 through FIG. 4, it will be understood that many field emitters are typically formed within the crystal surface in grids or clusters or other patterns. The number of emitters formed in the crystal or on the metal layer can be optimized for a particular application or system.

Figure 5:
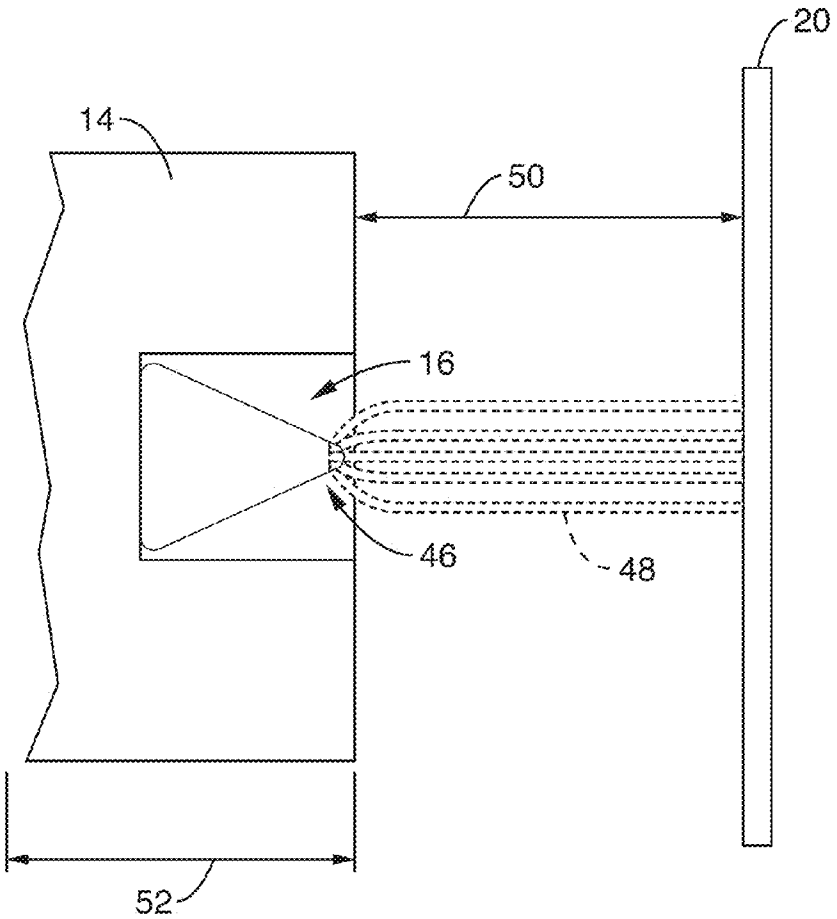
FIG. 5 is a detail side view of a field emitter, gap and target sections according to the invention.

Referring also to FIG. 5, electrons emitted from tip 46 of emitter 16 in the surface of crystal 14 are accelerated in field 48 to a target 20 that converts the electron pulse to x-rays via bremsstrahlung. Target 20 is preferably a generally thin metal wafers or foils made from materials such as tungsten, copper, and molybdenum. Combinations of these materials can also be used to tailor the emission spectrum. The specific target 20 material does not alter the general functionality of the device.

The geometry of the target 20 can also be altered. In the preferred embodiment, the emitted electron beam is perpendicular (normal) to the target surface and conversion occurs through transmission (i.e. the x-rays are collected on the opposite side of the target from the location of the electron beam). In another embodiment, the target 20 can oriented at an angle to the electron trajectory, typically at approximately 45 degrees, and the x-rays are collected in reflection (i.e. the x-rays are collected on the same side of the target as the point of impact of the electron beam).

The thickness of the target 20 is preferably selected to produce the highest conversion efficiency based on the nominal electron energy. Since the electron energy will depend in part on the characteristics of the selected crystal material, its thickness and geometry, the target thickness and material should be selected to match the emission characteristics of the crystal 14. In principle, analytic formulas and simulations are available in the field to calculate the optimum thickness of a target. In practice, one often selects the target characteristics based on past experience and laboratory measurements. For instance, a 10 micron thick Tungsten target is often employed in energies of interest here (20-100 KV).

Another consideration is the distance 50 between the emitter and the target. The distance 50 within gap 28 that is required is preferably selected so that breakdown between the crystal generated field and the ground plane of the target does not occur. In practice, this gap distance 50 will depend on the surface fields, the environment in the gap 28, and the surface smoothness of the target 20. For a vacuum gap and surface fields up to 50 KV, a gap distance of up to 1 mm or more may be required. The dimensions of the gap 28 and gap distance 50 between the emitter tip 46 and the target 20 can be adjusted with sidewalls (not shown) or adhesive sealants to enclose the gap space 28 and forms a consistent gap distance 50 between the emitter 46 and the target 20.

In the case of a thin crystal 14 separated an appreciable distance from the anode target 20, the field generated is proportional to the product of the crystal thickness 52 and the temperature gradient. Since these materials are typically poor thermal conductors, the thickness of the crystal 14 plays a strong role in the temperature gradient achievable over a relevant time scale.

Simple models of field generation which use measured parameters known in the art are able to fit the observed conditions. As an example, it is known that in an ideal planar geometry the field generated in a crystal of thickness $d_{cr}$ and separated from an anode by a gap distance $d_g$, can be expressed as $$E_0 = \frac{-\gamma\delta T}{\varepsilon_0 d_{cr} + \varepsilon_{cr} d_g} d_{cr}$$

where δT is the temperature gradient from the bottom to the top of the crystal, and $\in_{cr}$ ($\in_0$) is the crystal (free space) permittivity. The pyroelectric coefficient γ may be obtained empirically.

A typical pyroelectric emitter configuration using lithium niobate, for example, has a pyroelectric coefficient γ of $-8.3\times 10^{-5}$C/° C./m$^2$; a crystal thickness $d_{cr}$ of approximately 1 mm; a crystal to anode gap distance $d_g$ of approximately 1 mm; a temperature gradient from the bottom to the top of the crystal δT of 10° C. and the relative dielectric permittivity $\in_{cr}/\in_0$ of about 31. The generated field (using the above equation) is approximately 30 kV. A larger gap distance 50 or larger temperature gradient would produce a higher field.

Temperature cycling of the crystal 14 with the temperature control device 12 can also be optimized with the selected module configuration. The rate of temperature increase and cooling can be monitored and controlled to provide a continuous even beam of electrons emitted from the emitter head with maximized energy. In one embodiment, for example, temperature cycling between 5° C. and 30° C. above ambient with a gradient of approximately 4° C. to 6° C. per minute is used. Emissions of electrons can take place during heating or cooling of the crystal 14, depending on the crystal plane orientation. Rates of temperature change in the crystal 14 can be correlated with the number and design of emitters 16 and the characteristics of the resulting x-rays.

The gap 50 is preferably evacuated and sealed so that a low pressure or vacuum atmosphere is maintained within the panel. The pressure within the gap 28 is preferably maintained within the UHV range of better than $10^{-6}$ Torr. Although this range of pressures is preferred, any pressure can be used that does not substantially mask the pyroelectric or piezoelectric effects.

Gasses such as sulfur hexafluoride (SF6), an arc quenching medium to limit flashovers, or simply dry nitrogen may be employed in place of vacuum in some settings or can be used as a ballast gas replacing residual air in one embodiment. The ballast gases are preferably dilute to keep a low pressure, low oxygen atmosphere within the gap 28 and panel.

Referring back to FIG. 2 through FIG. 4, spatial and spectral filters may optionally be used with the x-ray source target layer 20. In the embodiment shown, the spectral filter 22 is applied directly to the target layer 20 and may be composed of a plurality of thin layers of metals. This stack of layers forming filter 22 aids in shaping the x-ray spectrum to reduce the presence of low energy x-rays, for example. Aluminum, copper and beryllium are common filter materials. Secondary layers of high atomic number metals such as tantalum or iron may also be used. In practice, the spectral filters 22 are selected based on the end use.

A spatial filter 22 may also be used to flatten the flux profile of the entire array. The spatial filter 22 can compensate for both the variation across one emitter and across an array of the emitter modules. Spatial variation across each emitter is due to the inherent distribution of electrons emitted by a specific emitter tip geometry convolved with the target emission. Variation across different emitters may be caused by manufacturing deviations or imperfections. In practice, the spatial filter 22 would be a micro patterned material with sufficient attenuation in the x-rays. A variety of high atomic number materials would be suitable. In all cases, the filters 22 enhance the functionality of the device, but do not fundamentally alter the operation.

Collimation of x-ray sources allows for a greater percentage of the photons (the flux) to be directed towards the intended area. In conventional point source x-ray sources (such as tubes), collimation may serve to increase the usable flux, and also often serves as a spatial filter. In a flat panel source according to the invention, or any large array of emitters, collimation further serves to ensure parallel emission of usable x-rays. For a point source, a "cone" shaped beam is desired. However, in an extended array source, the x-rays must be collimated into parallel "rays".

There are a number of approaches that can be used for the collimation of produced x-rays. In general, two types of optional collimators 24 may be considered. The first type of collimator 24 is the use of non-imaging optics that directs the x-rays through a series of reflections along a tube-like structure. In one embodiment, a metallic tube can serve as a non-imaging collimator 24. More efficient shapes such as the Winston cone can also be used to improve collimation efficiency.

The second category of collimator 24 are imaging or refracting optics such as lenses. X-ray lenses configured in arrays of lenses, often called lenslets, can be created with low atomic number metals such as lithium, beryllium and aluminum. For either category of collimator 24, the highest efficiency is achieved when each collimating element is aligned to each emitter in the array.

The field enhancement of the modules of the device is influenced, in part, by the design of the field emitter 16 and the configuration of the plurality of emitter tips 46. Several possible emitter 16 configurations are shown in cross-section in FIG. 6. An SEM micrograph of a tapered cylinder emitter tip 46 embodiment is shown in FIG. 7 and a micrograph of a wedge shaped emitter tip configuration embodiment is shown in FIG. 8.

The emitter tip dimensions can be optimized to produce a preferably continuous beam of electrons to the target 20. For example, the level of field enhancement for a long and narrow emitter 46 is inversely proportional to the tip radius, and proportional to the length of the emitter member. The field created by a needle-like emitter can be determined by the following equation:

$$E_{tip} = E_0 \frac{a^2}{b^2} \frac{\eta^3}{\arctan(\eta) - \eta},$$

where $E_0$ is the applied field, a is the emitter length, b is the diameter at the base of the emitter, and $$\eta = \sqrt{1 - \frac{b^2}{a^2}}$$

is a convenient geometric parameter. The tip radius would be given by the expression: $r_{tip}=b^2/a$.

The level of field enhancement required is a function of the tip material and the applied field. For the cases of interest here, with fields in the 10-100 kV range over mm-cm gaps, the field enhancements are in the 100-1000 range, assuming metallic tips. It should be noted that these required levels of field enhancement are rather modest, especially when compared with plasma TV and carbon nanotube levels.

The tips 46 of the cylindrical emitter body or pyramid or the leading edge of the wedge formed by parallel trenches can be coated with a material that will limit erosion of the thin edge or tip during use that does not interfere with the emission of electrons during use. In one embodiment shown in FIG. 6, the tip 46 has one or more metal projections that serve as the point of emission for field enhancement. In another embodiment, the tip 46 of the emitter is above the level of the planar surface of the crystal and the metal layer 18. The emitter designs of FIG. 6 can be associated with crystal types, temperature gradients, component dimensions, produced electron energies and the like to optimize a module or an array of modules for specific purposes.

It will be seen that the modules shown in FIG. 1 through FIG. 4 can be built on low voltage disposable "tiles" that are self contained and can be organized into an addressable array. The modules can generate diagnostic X-rays without the need for fragile vacuum tubes and bulky, expensive power electronics and radioactive materials.

Parallel X-rays can be generated uniformly across a flat panel with a small footprint that is light weight and portable and battery powered. Systems based on a plane parallel emission (unavailable from current commercial x-ray systems) can be deployed in remote locations and applied to circumstances where current x-ray imaging is not available for use. Furthermore, the use of an addressable array creates the opportunity to be selective in the locations where x-rays are applied to a patient.

Systems can also be devised that provide imaging platforms that are smaller, lighter and less expensive to operate than conventionally used in the art. For example, the device could be used in the an Intensive Care Unit (ICU) or Emergency Room (ER) setting to spare the patient an unnecessary trip to the radiology suite, and perhaps also at the point of wounding to confirm intubation or whether a patient's lung has collapsed.

Referring now to FIG. 9 and FIG. 10, one embodiment of an imaging system 60 is generally shown. In this illustration, the modules are organized in a rigid flat panel array 62 in a durable shielded housing 64 that contains a control unit 66 with temperature and x-ray sensors, and a positioning system 72.

The panel 62 of integrated modules provides an addressable array of sources producing parallel x-rays from the face of the device and controlled by a preferably programmable controller 66.

In use, the array 60 can be placed beneath or on top of an area of a patient that needs to be imaged. An imager 74 is placed opposite the array 60. The imager 74 can either be a digital imager or can contain conventional x-ray film. The subject is placed within space 76 between the array 60 and the imager 74. In the embodiment shown, a positioning system 72 indicates the proper alignment of the array 60 and the imager 74.

A remote actuator 68 with trigger 70 sends a signal 78 to the controller 66 to initiate the x-ray emissions for imaging. In the embodiment shown in FIG. 9 and FIG. 10, the remote actuator 68 also reversibly attaches to the housing 64 and serves as a handle for transporting the array 60.

The compact size (less than 1 cubic foot) and weight (under 10 kg) of the imaging system lead to applications requiring transportability, flexibility, speed, and/or low cost. The overall breadbox size and weight of the imaging system 60 can be an order of magnitude smaller than any comparable high-energy x-ray device. If mounted in a ruggedized housing 64, the imager 60 could easily be carried as part of a medical pack. No external high voltage is needed, making battery-powered field operation possible.

The array device 60 can be adapted for use with a number of commercial applications. These applications include, but are not limited to, field units for military operations and basic medical care in remote or undeveloped regions, and first responders. Many possible configurations exist, including a disposable device generating x-ray images using Polaroid-type film, or a palm-sized device using a digital imager. A medical device based on one of the variants of the device could allow for first responders to produce x-ray radiographs, including from digital devices enabled for telemedicine.

The method of use would also depend on the source configuration (point, line, or flat panel). A point source is the most compact, and has the highest energy density. A bar or line source could be "rolled" across the area to be imaged, whereas an array (flat panel) would allow for equal illumination of a wound area, giving true plane-parallel projections to enable localization of injuries or shrapnel. Flat panel arrays can also be addressable (with selectively activated pixels), and a control unit could perform a form of 2D tomographic reconstruction by scanning through every pixel and obtaining a complete image from each source point.

The invention may be better understood with reference to the accompanying examples, which are intended for purposes of illustration only and should not be construed as in any sense limiting the scope of the present invention as defined in the claims appended hereto.

Example 1

In order to demonstrate the functionality of the apparatus, pyroelectric crystals with a variety of field emission tip configurations according to the invention were produced and evaluated. Previous experimental findings on pyroelectric electron emission from lithium niobate ($LiNbO_3$) crystals have demonstrated that both qualitative and quantitative features of the emission are strongly dependent on the detailed geometry of the experiment, including the vacuum vessel, anode configuration, and crystal size and shape. Depending on the ambient gas pressure, rate of temperature change, and anode distance, currents can be produced through field emission, surface plasma formation, or gas ionization; currents of picoamperes to nanoamperes have been reported, over time scales of a few minutes to a few hours. Therefore, lithium niobate ($LiNbO_3$) crystals are a good illustration of one apparatus for x-ray production according to the invention.

A first series of experimental tests was performed using a 1 cm×1 cm wafer of LiNbO3, 500 μm thick. The wafer was cross-cut, with the Z-faces along the narrow edges. One of the narrow edges was plated with a gold layer, which was then milled away (using a focused ion beam machine) over a narrow strip (10 μm×100 μm) in the center, exposing the crystal and, optionally, creating one or more sharp tips. The sharpness of the surface features could not be measured directly but was believed to be well below a radius of curvature of 1 μm. The wafer was then placed in a test stand in which the emitted electrons were imaged on a scintillating screen while the temperature of the wafer was controlled from the side using a Peltier element adjacent to the crystal, while temperature was measured on the opposite side of the crystal. Vacuum pressure of roughly 1.0×10-5 Torr was maintained during each of the test runs.

Several different methods for gold deposition on the upper surface of the crystals were used, including sputtering and evaporation, with thicknesses varying from 20-30 nm to 175 nm.

A variety of tip configurations were tested (such as the "flat" and "pointed" cross-sectional geometries in FIG. 6), with roughly consistent rates of temperature change, followed by frame-by-frame postprocessing of the resulting video images. It was conjectured that current emission would be limited to the milled region but enhanced by the presence of the gold layer, which could allow surface electrons to migrate.

Electron emission was successfully observed from three thin crystals during heating or cooling, with results that were clearly dependent on the geometry of the emitting tips. In these tests, the temperature was varied between 5° C. and 35° C. above ambient temperature, and was changed at a rate of 4-6° C./min. Emission from the tip configurations produced a slowly decaying steady current combined with several "flashes" (runaway discharge events) during cooling. Two different tip cross-sections produced emission. One tip was formed as a thin wedge shaped wall between two channels milled in the surface of the crystal. In a second tip, having a similar wedge shaped wall between two channels, an edge of metal was formed on the top beveled surface of the wall. In both cases, sharp ridges existed over a large portion of the emitter.

As a comparison, an emitter was fabricated having a central milled region with a flat bottom (no tip or ridges). This geometry did not produce any detectable current. The field enhancement due to the sharp ridges or tips thus makes a necessary contribution to pyroelectric electron emission.

The variation in intensity of the electron emissions showed among runs suggested that the primary emission mechanism observed was gas ionization in the relatively poor vacuum, with the resulting low-density plasma supporting a steady current between crystal and anode for periods of at least 2 to 5 minutes. Though the tips clearly contributed to the formation of an ionizing electric field, emission from the surface may not have made a significant contribution to the steady current (though isolated surface breakdown events led to single bursts of current at the detector). Accordingly, strong fields can lead to current at the anode by field emission from the surface or surface plasma flashover or plasma current after ionization of nearby residual gas.

A second series of tests were conducted with a thicker group of crystals was conducted. The second configuration was a cylinder of LiNbO3 with height 1 cm and diameter 7.6 cm, cut so that the flat surfaces were the Z faces of the crystal. As with the thin crystal, several emitting tips (in this case with a 1:1 aspect ratio) were milled into the surface of the crystal face. The tips were re-metallized after milling of the trenches. The radius of curvature of the tip was measured to be approximately 1 μm. The crystal was placed atop a thin copper plate and heated from below, with temperature monitoring via thermistors. A scintillator screen was imaged with a CCD camera. The large crystal tests were carried out at a vacuum pressure of 1.0-5.0×$10^{-5}$ Torr.

It was shown that sharply pointed surface features can enhance pyroelectric emission from lithium niobate crystals, leading to a persistent and steady current over several minutes. Field enhancement by sharp tips has been shown to contribute directly to the emission of electrons from the crystal. Pyroelectric crystals enhanced in this way have potential to serve as sources of miniature electron beams suitable for micron-scale acceleration devices or industrial or medical radiation source crystals enhanced in this way have potential to serve as sources of miniature electron beams suitable for micron-scale acceleration devices or industrial or medical radiation sources.

From the discussion above it will be appreciated that the invention can be embodied in various ways, including but not limited to the following:

1. An apparatus, comprising a pyroelectric crystal having an upper surface with a conducting film coating the upper surface of the crystal including a plurality of electron field emitters, the emitters comprising a micrometer-scale exposed region on the crystal, the exposed region having a one or more sharp peaks or ridges; and a heater/cooler adjacent the crystal; wherein the crystal and the emitters are maintained in a low pressure environment.

2. An apparatus according to embodiment 1, wherein each field emitter comprises a pattern etched into the crystal.

3. An apparatus according to embodiment 1, wherein each field emitter further comprises a layer of nanotubes on the peaks or ridges of the emitter.

4. An apparatus according to embodiment 1, wherein each field emitter further comprises a second conducting film coating the conducting film and the micrometer-scale exposed regions of the crystal.

5. An apparatus according to embodiment 1, further comprising a target disposed in proximity to the plurality of electron field emitters; wherein electrons emitted from the emitters impinge upon the target to produce x-rays.

6. An apparatus according to embodiment 5, further comprising an x-ray filter configured to filter x-rays emanating from the target.

7. An apparatus according to embodiment 5, further comprising an x-ray collimator.

8. An apparatus according to embodiment 1, wherein the sharp peaks or ridges are etched into the crystal surface using a conventional fabrication method and have a height to width aspect ratio greater than one and are generally pyramidal or wedge shaped with side walls with angles of 45 degrees or greater.

9. An apparatus, comprising a modular housing; a pyroelectric crystal having an upper surface; a plurality of electron field emitters formed on the coated surface of the crystal comprising a micrometer-scale excavated region on the crystal, the excavated region having a one or more sharp peaks or ridges; a conducting film coating the crystal and the excavated field emitters; means for controlling the temperature of the crystal over time adjacent the crystal; and a target disposed in proximity to the plurality of electron field emitters; wherein electrons emitted from the emitters impinge upon the target to produce x-rays; and said crystal and the emitters are maintained in a low pressure environment within the modular housing.

10. An apparatus according to embodiment 9, wherein the pyroelectric crystal is a crystal selected from the group of crystals consisting essentially of a lithium niobate crystal, a lithium tantalate crystal, a barium titanate crystal and a triglycine sulfate crystal.

11. An apparatus according to embodiment 9, wherein the target comprises a metal sheet capable of converting an electron pulse to x-rays via bremsstrahlung; a second pyroelectric crystal of opposite polarity to the first pyroelectric crystal coupled to the metal sheet; and means for heating or cooling the crystal; wherein a second electric field is produced by the second crystal.

12. An apparatus according to embodiment 9, further comprising an x-ray filter configured to filter x-rays emanating from the target.

13. An apparatus according to embodiment 9, further comprising an x-ray collimator.

14. An apparatus according to embodiment 9, further comprising an addressable array of modules; a flexible support substrate coupled to the modules; a programmable controller configured to selectively control the means for controlling the crystal temperature to heat and cool the crystals of each module over a period of time so that spontaneous charge polarization occurs in the crystals, thereby causing a perpendicular electric field to arise on its top and bottom faces of the crystal; wherein the electric field is enhanced by the sharp peaks or ridges, thereby causing field emission of surface electrons from that location toward the target and thereby converting electron pulses from the field emitter into x-rays.

15. An apparatus according to embodiment 9, wherein each exposed field emitter comprises a pattern of parallel linear trenches excavated into the crystal forming one or more wedge shaped members with sharp peaks having a height to width aspect ratio greater than one.

16. An apparatus according to embodiment 9, wherein each exposed field emitter comprises a pattern of cavities that each have a central tapered column.

17. An apparatus according to embodiment 9, wherein the means for controlling the temperature of the crystal comprises a Peltier junction.

18. An apparatus, comprising a modular housing; a pyroelectric or piezoelectric crystal having an upper surface; means for controlling the strain or temperature of said crystal over time coupled to the crystal; a conducting film coating the upper surface of the crystal; a plurality of electron field emitters formed on a top surface of said conducting film, the emitters comprising a plurality of sharp peaks or ridges; and a target, disposed in proximity to the plurality of electron field emitters; wherein electrons emitted from the emitters impinge upon the target to produce x-rays; wherein the crystal and emitters are maintained in a low pressure environment within the modular housing.

19. An apparatus according to embodiment 18, further comprising a spectral or spatial filter downstream of the target; and a collimator downstream of the filter.

20. An apparatus according to embodiment 18, wherein the sharp peaks or ridges have a height to width aspect ratio greater than one and are generally pyramidal or wedge shaped with side walls with angles of 45 degrees or greater.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus, comprising:

a pyroelectric crystal having an upper surface;

a conducting film coating the upper surface of the crystal;

said crystal including a plurality of electron field emitters, the electron field emitters comprising a micrometer-scale exposed region on the crystal, the exposed region having one or more sharp peaks or ridges;

a second conducting film coating the conducting film and the micrometer-scale exposed regions of the crystal; and a heater/cooler adjacent to the crystal;

wherein said crystal and said electron field emitters are maintained in a low pressure environment.

2. An apparatus as recited in claim 1, wherein each electron field emitter comprises a pattern etched into the crystal.

3. An apparatus as recited in claim 1, wherein each electron field emitter further comprises a layer of nanotubes on said peaks or ridges of said electron field emitter.

4. An apparatus as recited in claim 1, further comprising:

a target, said target disposed in proximity to said plurality of electron field emitters;

wherein electrons emitted from said emitters impinge upon said target to produce x-rays.

5. An apparatus as recited in claim 4, further comprising:

an x-ray filter, said filter configured to filter x-rays emanating from said target.

6. An apparatus as recited in claim 4, further comprising an x-ray collimator.

7. An apparatus as recited in claim 1:

wherein the sharp peaks or ridges have a height to width aspect ratio greater than one;

wherein the sharp peaks or ridges are generally pyramidal or wedge shaped; and wherein the sharp peaks or ridges have side walls with angles of 45 degrees or greater with respect to a horizontal base of the peaks or ridges.

8. An apparatus, comprising:

a housing;

a pyroelectric crystal having an upper surface;

a plurality of electron field emitters formed on said upper surface of said crystal, the emitters comprising a pattern of parallel linear trenches excavated into the crystal forming one or more wedge shaped members with sharp peaks having a height to width aspect ratio greater than one;

a conducting film coating said crystal and said excavated field emitters;

a heater/cooler adjacent to the crystal configured to control the temperature of said crystal over time; and a target, disposed in proximity to said plurality of electron field emitters;

wherein electrons emitted from said electron field emitters impinge upon said target to produce x-rays;

wherein said crystal and said electron field emitters are maintained in a low pressure environment within said housing.

9. An apparatus as recited in claim 8, wherein the pyroelectric crystal is a crystal selected from the group of crystals consisting essentially of a lithium niobate crystal, a lithium tantalate crystal, a barium titanate crystal and a triglycine sulfate crystal.

10. An apparatus as recited in claim 8, further comprising:

an x-ray filter, said filter configured to filter x-rays emanating from said target.

11. An apparatus as recited in claim 8, further comprising an x-ray collimator.

12. An apparatus as recited in claim 8, further comprising:

an addressable array of modules;

a flexible support substrate coupled to said modules;

a programmable controller, said controller configured to selectively control said heater/cooler to selectively control the crystal temperature to heat and cool the crystals of each module over a period of time so that spontaneous charge polarization occurs in the crystals, thereby causing a perpendicular electric field to arise on the top and bottom faces of the crystal; and wherein the electric field is enhanced by sharp peaks or ridges, thereby causing field emission of surface electrons from that location toward said target and thereby converting electron pulses from each electron field emitter into x-rays.

13. An apparatus as recited in claim 8, wherein each exposed electron field emitter comprises a pattern of cavities that each have a central tapered column.

14. An apparatus as recited in claim 8, wherein said heater/cooler comprises a Peltier junction.

15. An apparatus, comprising:

a housing;

an array of a plurality of piezoelectric crystals, each crystal having an upper surface and a lower surface;

means for controlling the strain of said crystal over time coupled to the lower surface of each crystal;

a first conducting film coating the upper surface of the crystal;

a plurality of electron field emitters formed through said first conducting film and on said upper surface of each crystal, the emitters comprising a plurality of sharp peaks or ridges;

a second conductive film coating the first conductive film and the plurality of electron field emitters of each crystal; and a target, disposed in proximity to said plurality of electron field emitters;

wherein electrons emitted from said electron field emitters impinge upon said target to produce x-rays; and wherein said crystal and said electron field emitters are maintained in a low pressure environment within the housing.

16. An apparatus as recited in claim 15, further comprising:

a spectral or spatial filter downstream of the target; and a collimator downstream of the filter.

17. An apparatus as recited in claim 15:

wherein the sharp peaks or ridges have a height to width aspect ratio greater than one;

wherein the sharp peaks or ridges are generally pyramidal or wedge shaped; and wherein the sharp peaks or ridges have side walls with angles of 45 degrees or greater with respect to a horizontal base of said peaks or ridges.

* * * * *